US005554094A

United States Patent [19]

Viens

[11] Patent Number: 5,554,094

[45] Date of Patent: Sep. 10, 1996

[54] FOLDING APPARATUS

[75] Inventor: Wilfred S. Viens, Lisbon, Conn.

[73] Assignee: Gunther International, Ltd., Norwich, Conn.

[21] Appl. No.: 238,325

[22] Filed: May 5, 1994

[51] Int. Cl.[6] ..... B65H 45/14

[52] U.S. Cl. ..... 493/421; 493/405; 493/419; 493/417; 493/442

[58] Field of Search ..... 493/243, 244, 493/246, 248, 249, 405, 408, 416, 420, 421, 419, 436, 441, 442, 460, 461, 417

[56] References Cited

U.S. PATENT DOCUMENTS

| | | | |
|---|---|---|---|
| 2,230,168 | 1/1941 | Spiess | 493/421 |
| 3,328,026 | 6/1967 | Bartizal, Jr. | 493/421 |
| 3,975,009 | 8/1976 | Brown | 493/421 |
| 4,701,233 | 10/1987 | Beck et al. | 493/421 |
| 4,850,945 | 7/1989 | Whittenberger | 493/421 |
| 5,183,246 | 2/1993 | Edwards et al. | 493/421 |
| 5,246,415 | 9/1993 | Fuss | 493/421 |
| 5,269,744 | 12/1993 | Moll | 493/421 |

*Primary Examiner*—Bruce M. Kisliuk
*Assistant Examiner*—Eileen P. Morgan
*Attorney, Agent, or Firm*—Ware, Fressola, Van Der Sluys & Adolphson

[57] ABSTRACT

An apparatus for folding products utilizes interchangeable buckle plates and bypass plates as well as a buckle plate and diverting device combination to accomplish various folding formats, i.e. Z-folding, C-folding and half-folding. When the product is a combination of a document with an insert, the document is folded around the insert as initially the diverting device operates to deflect the leading edge of the product into its associated buckle plate to begin the folding process. The folding apparatus is design for use in an electronic publishing system.

19 Claims, 7 Drawing Sheets

FOLDING APPARATUS

BACKGROUND OF THE INVENTION

1. Field of the Invention

The present invention relates to an apparatus for folding paper documents and, more particularly, to an apparatus for folding paper documents which can achieve different types of folds including folding around inserts.

2. Description of the Prior Art

In the electronic publishing field, multi-page documents such as insurance policies and contracts are printed on high-speed laser printers and then finished on an electronic publishing system which assembles the document, adds any desired inserts (such as prefolded advertising brochures or other solicitations) to the document to create a product, folds the product in a desired known configuration (C-fold, Z-fold or half fold) and then inserts the product into a standard envelope to create a package ready for mailing. These steps are done at high speed while the accuracy of the document assembly is verified through use of a printed bar code on each sheet of the document.

One prior art device for folding the product is known as a cassette folder. In the typical cassette folder, the product is transported to the folder with its inserts at the leading edge of the document. The product is stopped, clamped and flipped to create a fold. To create a second fold as would be necessary for C-folding or Z-folding, the product is transported to a second station where it is stopped, clamped and flipped to create the desired second fold. The cassette folder operates comparatively slowly as the stopping and clamping of the product is time consuming.

Another "prior art" folding apparatus utilizes a tucker plate for creating the fold in the product. The product is transported to the folder with its insert on the leading or trailing edge. The product is stopped and the tucker plate engages the product at a ninety degree (90°) angle to create the fold. The direction of movement of the product is change ninety degrees (90°) from the original transport direction. Such tucker plate folding apparatus is also relatively slow in processing products because of the need to stop the products and change their direction of movement.

In yet another prior art folding apparatus, the document (without an insert) is driven into a buckle plate where the leading edge engages an abutment stop. The trailing edge of the document continues to be driven until the document is caught at the desired fold location between the nip of a pair of driven rollers. The driven rollers pull the document through the nip creating the fold. If desired, the document can be sent through another buckle plate arrangement to create additional folds. Buckle plate folding apparatus operate at higher speed than the previously mentioned cassette and tucker plate folding apparatus but are unable to fold documents around inserts.

The present invention is designed to overcome the above limitations that are attendant upon the use of "prior art" devices, and toward this end, it contemplates the provision of a novel apparatus for creating folds in a product, which utilizes a moveable diverting device for directing the product into a standard buckle plate.

It is an object of the present invention to utilize buckle plates to fold a document around an insert.

It is also an object to provide such an apparatus which can be easily converted to accomplish C-folding, Z-folding or half folding.

Still another object is to provide such an apparatus which can accommodate products of various thicknesses.

Yet another object is to provide an apparatus which accomplishes the desired folding formats at high speeds.

A further object is to provide an apparatus that is compatible with conventional electronic publishing systems and is generally compatible in physical size, form and configuration with "prior art" devices, to be readily adaptable for the same use without disadvantage.

It is a general aim of the invention to provide such an apparatus which may be readily and economically fabricated and will have long life in operation and significantly greater flexibility in use.

SUMMARY OF THE INVENTION

It has now been found that the foregoing and related objects can be readily attained in a folding apparatus for providing a product with at least one fold which includes an input conveying device for delivering the product in a first path to a folding device. The folding device folds the product in the desired Z-fold, C-fold or half-fold format and delivers it to an output conveyor.

Desirably, the folding device for receiving the product from the input conveying device has three stations. The first station incorporates a diverting device for diverting a leading edge of the product as the product moves in the first path and changing a direction of movement of the leading edge to a second path if a fold is to be made at the first station. The diverting device is designed to be moveable between an operative position in the first path of the product as the leading edge thereof exits from the input conveying device and an inoperative position spaced from the first path of the product.

If a fold is being created at the first station, a buckle plate is located in the second path for stopping movement of the leading edge of the product along the second path when a fold is to be made. A first driven roller device creates a first nip for engaging the product. The first nip engages an intermediate portion of the product between the leading edge and a trailing edge thereof when a fold is being made at the first station after movement of the leading edge thereof has been stopped in the second path. The first driven roller device draws the product through the first nip in a third path to create a folded edge at the intermediate portion of the product. If a fold is not being made at the first station, the diverting device is removed or inactivated and the first nip merely engages the leading edge of the product as it exits from the input conveying device.

At the second station, a buckle plate is locatable in the third path for stopping movement of the product along the third path when a fold is to be made at the second station. Otherwise, a first bypass device is locatable in the third path after the first nip when a fold is not to be made at the second station. The first bypass device is designed to deflect the product as it moves in the third path.

The second station also includes a second driven roller device creating a second nip for engaging the product. The second driven roller device engages an intermediate portion of the product between the leading and trailing edges thereof when a fold is being made at the second station after movement of the product has been stopped by the buckle plate in the third path. The second driven roller device then draws the product through the second nip in a fourth path to create a folded edge at an intermediate portion of the product between the leading and trailing edges thereof. If a fold is not being made at the second station, the second nip engaging the product as it is deflected from the first bypass device and draws the product through the second nip in a fourth path.

At the third station, if a fold is being made, a buckle plate is locatable for stopping movement of the product along the fourth path. Alternatively, if no fold is to be made, a second bypass device is locatable in the fourth path after the second nip. The second bypass device is designed to deflect the product as it moves in the fourth path.

The third station also includes a third driven roller device creating a third nip for engaging the product. When a fold is being made at the third station, the third driven roller device engages an intermediate portion of the product between the leading and trailing edges thereof after movement of the product has been stopped in the fourth path. The third driven roller device draws the product through the third nip in a fifth path to create a fold at the intermediate portion of the product between the leading and trailing edges thereof and forwards the product to an output conveyor. When a fold is not being made at the third station, the third nip engages the product as it is deflected from the second bypass device and forwards the product to an output conveyor.

Conveniently, the first, second and third driven roller devices are each formed of cooperating rollers. At least one of the rollers being pivotally moveable about an axis spaced from its axis of rotation so as to be moveable relative to its respective cooperating roller to accommodate products of varying thicknesses. To permit the device to accommodate products of varying lengths, the buckle plates, when located in the first, second or third paths, for stopping movement of the product along the first, second or third paths are adjustable to accommodate varying product lengths.

The invention will be fully understood when reference is made to the following detailed description taken in conjunction with the accompanying drawings.

DETAILED DESCRIPTION OF THE INVENTION

Figure 1:
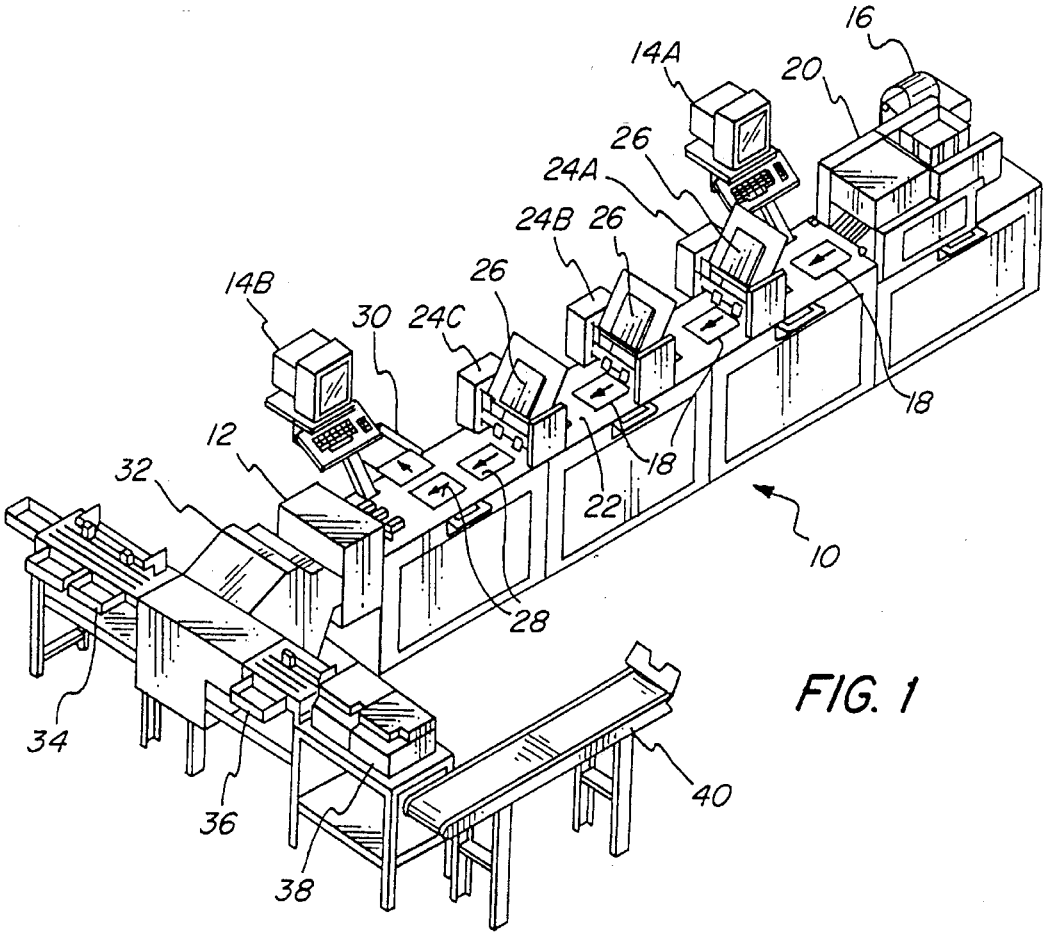
FIG. 1 is a perspective view of an electronic publishing system which utilizes the folding apparatus of the present invention.

Turning first to FIG. 1 of the drawings, therein illustrated is an electronic publishing system generally designated by the numeral 10 which utilizes a folding apparatus 12 made in accordance with the present invention. A computer processing unit (not shown) including two keyboard/monitor units 14A,14B allows the user to track the operation of the system 10. The system 10 has a high speed laser log printer 16 which tracks the operation of the system 10. Each sheet is printed with a bar code to verify the accuracy of its assembled document 18. Bar code readers and sensors (not shown) are appropriately located throughout the system 10 so the computer processing unit can monitor each document 18 as it proceeds through the system 10. A primary document feeder 20 assembles the sheets into the individual documents 18 and introduces the documents 18 onto a high-speed conveyor system 22 which transports the documents 18 through to the folding apparatus 12. Spaced above the conveyor system 22 is a trio of insert feeders 24A,24B, 24C for feeding inserts 26 onto the trailing edge of the document 18 to create a product 28. The computer processing unit controls the operation of the insert feeders 24A, 24B,24C and signals them to feed the appropriate insert(s) in accordance with the specific needs of document 18 passing underneath. Upon exiting from the last insert feeder 24C, the product 28 proceeds to the folding apparatus 12 or, if the computer processing unit determines that product 28 is oversized and cannot be folded by the folding apparatus 12, is diverted to a oversize divert station 30. If the product 28 proceeds to the folding apparatus 12, it is folded in a manner to be explained further hereinafter. Thereafter, the folded product 28 is inserted into an envelope at an enveloper 32 to create a package (not shown). The package proceeds to divert stations 34,36 or through postage meters 38 and onto a slowly indexed conveyor 40 where the packages are aligned in a shingled manner. The divert station 34 can be actuated by the computer processor unit to divert specific products for a variety of purposes such as auditing or stop payments on specific accounts. The divert station 36 allows overweight products to be diverted prior to being fed through the postage meters 38.

Figure 2:
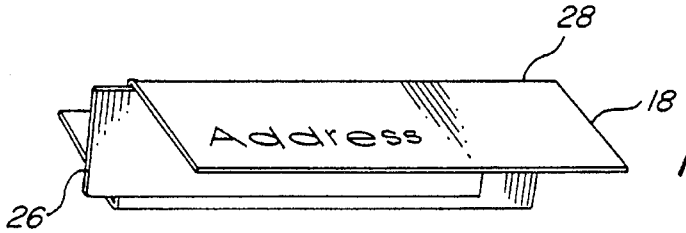
FIG. 2 is a perspective view of a Z-folded product formed by the present invention.
Figure 3:
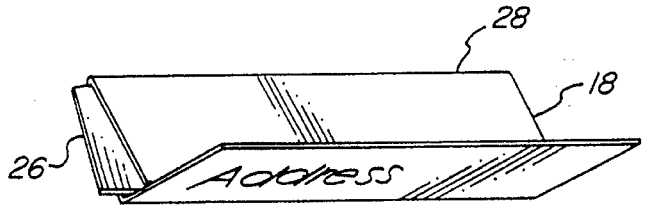
FIG. 3 is a perspective view of a C-folded product formed by the present invention.
Figure 4:
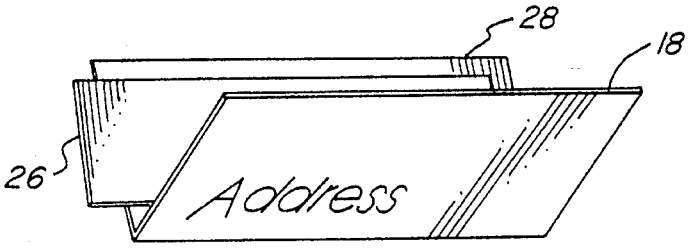
FIG. 4 is a perspective view of a half-folded product formed by the present invention.

Turning now to FIGS. 2 through 4, therein illustrated are three different types of folds which can be accomplished by the folding apparatus 12 of the present invention depending how the folding apparatus 12 is set up by the user. The product 28 of FIG. 2 is in the Z-fold format with the document 18 folded twice to form three sections with the ends of the document 18 along opposite sides of the center section and with the insert 26 between two of the sections. The product of FIG. 3 is in the C-fold format with the document 18 folded twice with its ends inward and overlapping each other to form three sections retaining the insert 26. The product 28 of FIG. 4 is in the half-fold format with the document 18 folded once to form two sections retaining the insert 26 therebetween. The documents 18 can also be folded without the inserts 26 therein.

Figure 5A:
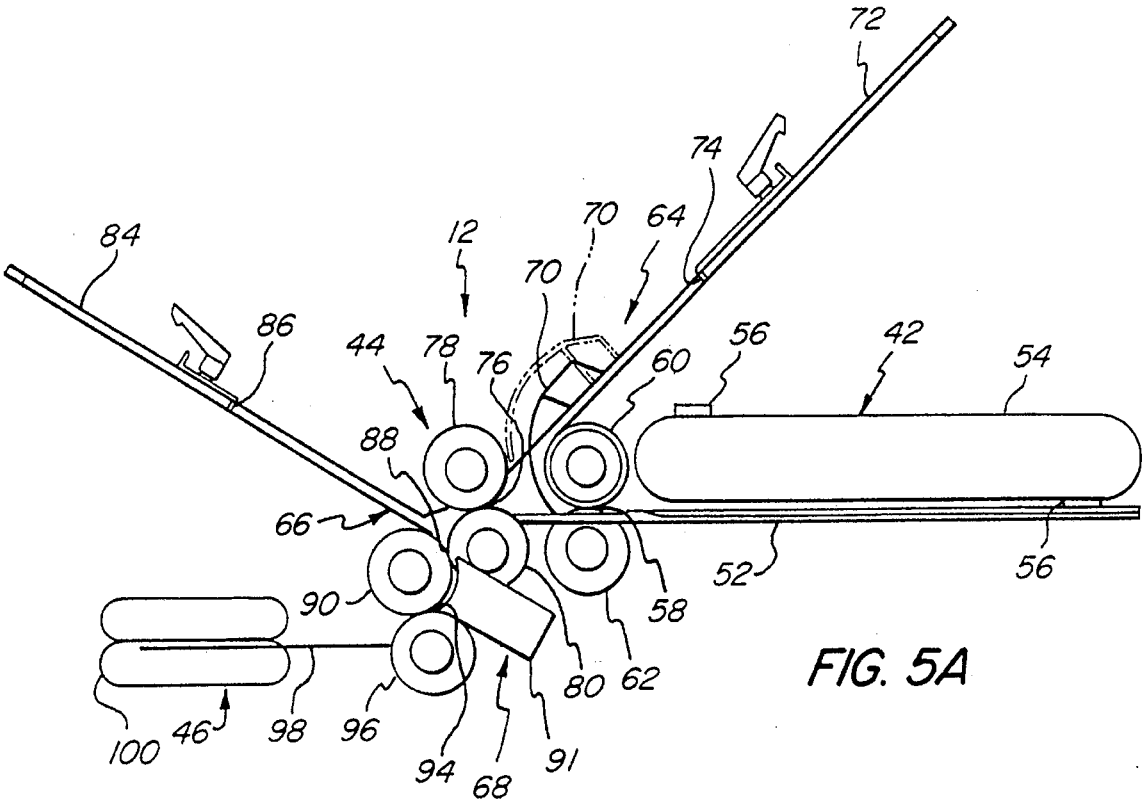
FIG. 5A is a fragmentary side elevational view of the folding apparatus of the present invention set up to create a Z-folded product.
Figure 5B:
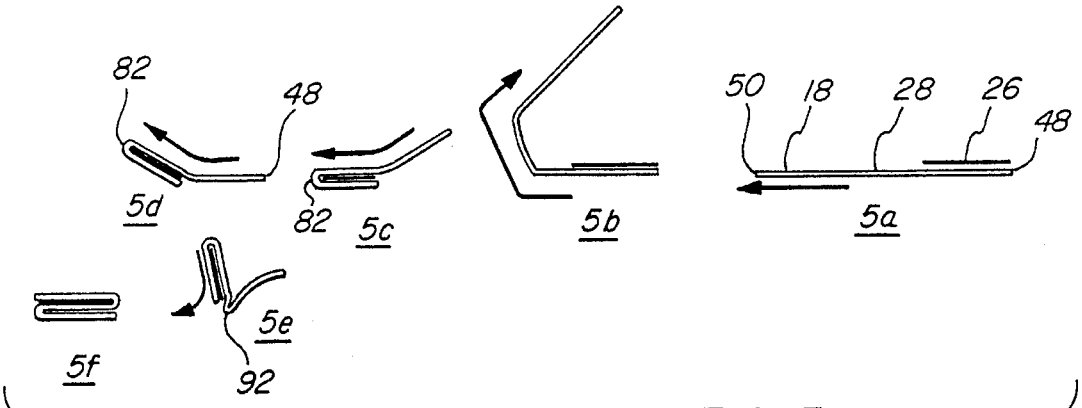
FIG. 5B is a schematic diagrammatic view of the product as it processed through the apparatus of FIG. 5A to create a Z-folded product.

Referring to FIGS. 5A and 5B, the folding apparatus 12 of the present invention is shown set up to form a product with a Z-fold therein. The folding apparatus 12 has an infeed device generally indicated by the numeral 42, a folding device generally indicated by the numeral 44 and an output device generally indicated by the numeral 46. The infeed device 42 accepts the product 28 from the conveyor system 22 (FIG. 1) with the document 18 in flat condition with the insert 26 thereon. The trailing edges of the documents 18 and insert 26 are aligned to form a trailing edge 48 of the product 28 spaced from a leading edge 50 thereof. The infeed device 42 includes an infeed guide 52 with an infeed conveyor 54 thereabove. The infeed conveyor 54 has two pusher devices 56 thereon moving in the clockwise direction in FIG. 5A. One of the pusher devices 56 engages the trailing edge 48 of the product 28 to move the product 28 into a nip 58 formed by cooperating upper and lower rollers 60, 62 of the folding device 44 with the trailing edge of the document 18 and insert aligned as indicated by position 5*a* in FIG. 5B. The upper roller 60 continually rotates clockwise while the lower roller 62 continually rotates counterclockwise as viewed in FIG. 5A to accept the product 28 from the infeed device 42.

Along the path of the product 28 through the folding apparatus 12, the folding device 44 has first, second and third stations generally indicated by the numerals 64, 66 and 68, respectively. Various operations can be performed at these stations, depending upon how the folding device 44 is arranged, to fold the product 28 in one of the Z-fold, C-fold or half-fold formats. In FIG. 5A, the folding device 44 has been set up to perform a Z-fold on the product 28.

To perform a Z-fold on the product 28, the first station 64 is set up with a diverting device 70 and a buckle plate 72. The diverting device 70 is for diverting the leading edge 50 of the product 28 as the product 28 moves in a first path (see position 5*a*) and changing a direction of movement of the leading edge 50 to a second path (see position 5*b*) into the buckle plate 72. The diverting device 70 is moveable between an operative position (shown in solid line in FIG. 5A) in the first path of the product 28 as the leading edge 50 thereof exits from the conveyor system 22 and an inoperative position (shown in phantom line in FIG. 5A) spaced from the first path of the product 28.

The buckle plate 72 has an adjustable stop 74 positionable by the user depending upon the size of the product 28. After the product 28 enters the buckle plate 72, the diverting device 70 moves to its inoperative position shown in phantom line in FIG. 5A. This movement is accomplished pneumatically and is controlled by the computer processing unit which is signalled by an appropriately located sensor (not shown) to detect the passage of the leading edge 50 of the product 28. With the diverting device 70 in its inoperative position, the leading edge 50 will engage the adjustable stop 74 to stop further movement of the product 28 in the second path. However, the cooperating rollers 62,64 continue to drive the product 28 causing an intermediate portion of the product 28 between the leading and trailing edges 48,50 thereof to engage a nip 76 formed by cooperating upper and lower rollers 78,80. The upper roller 78 continually rotates clockwise while the lower roller 80 continually rotates counterclockwise as viewed in FIG. 5A to accept the product 28 and create a first folded edge 82 therein as shown at position 5*c* as the product 28 is drawn through the nip 76 in a third path.

At the second station 66, a buckle plate 84 has been set up to accept the product 28 coming from the cooperating rollers 78,80 in the third path. The buckle plate 84 has an adjustable stop 86 in the third path for stopping movement of the folded edge 82 of the product 28 along the third path as shown in position 5*d*. After the folded edge 82 of the product 28 is stopped, the cooperating rollers 78,80 drive the intermediate portion of the product 28 between a nip 88 formed between the lower roller 80 and a roller 90 (position 5*e*). The roller 90 is continually driven in a clockwise direction as view in FIG. 5A. The rollers 80,90 drawing the product 28 through the nip 88 in a fourth path to create a folded edge 92 at the intermediate portion of the product 28 between the folded edge 82 and the trailing edge 48 thereof (position 5*e*).

As the product 28 enters the third station 68, a bypass device 91 located in the fourth path after the nip 88 deflects the product 28 into a nip 94 formed between the roller 90 and a roller 96. The roller 96 is continually driven in a counterclockwise direction as view in FIG. 5A. The rollers 90,96 draw the product 28 through the nip 94 sending the product 28 into the output device 46. The output device 46 includes an output guide 98 and an output conveyor 100 designed to deliver the product 28 to the enveloper 32 (FIG. 1) as shown by position 5*f*. Thus, a Z-folded product is formed.

Figure 6A:
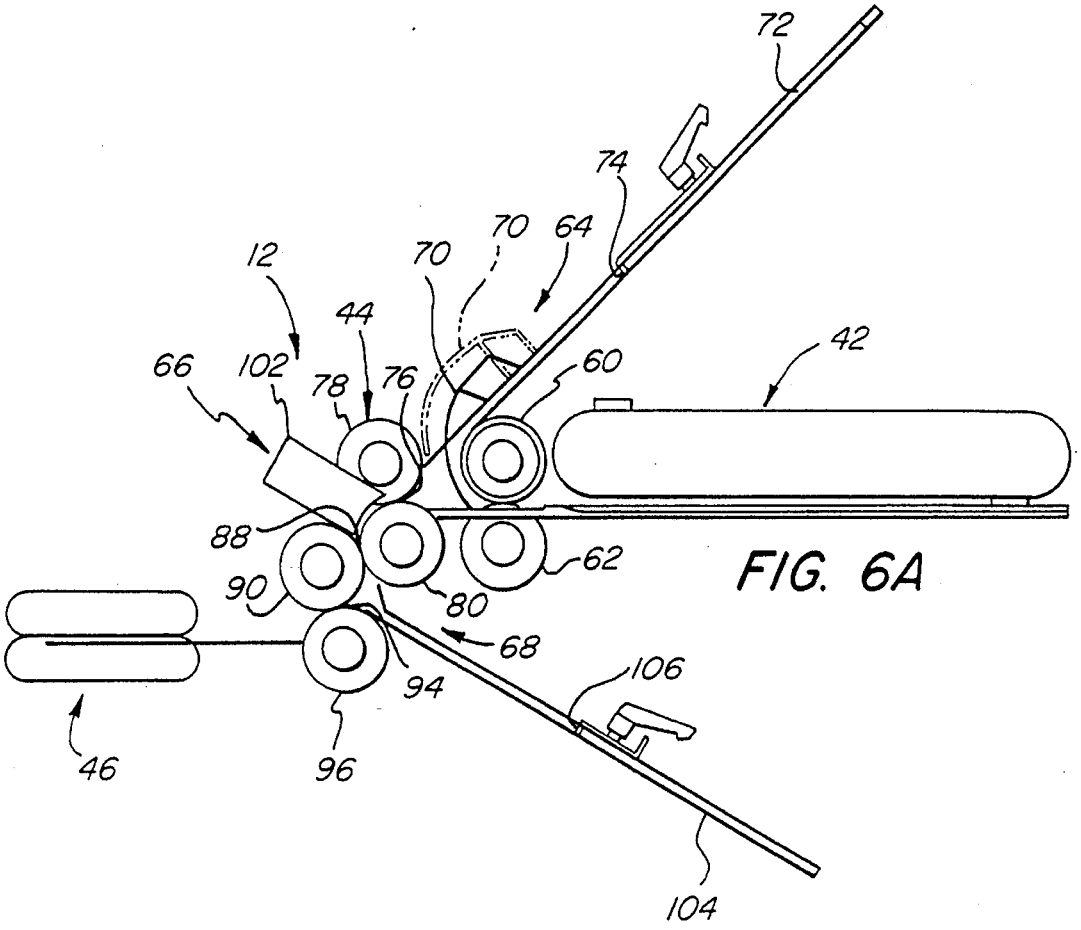
FIG. 6A is a fragmentary side elevational view of the folding apparatus of the present invention set up to create a C-folded product.
Figure 6B:
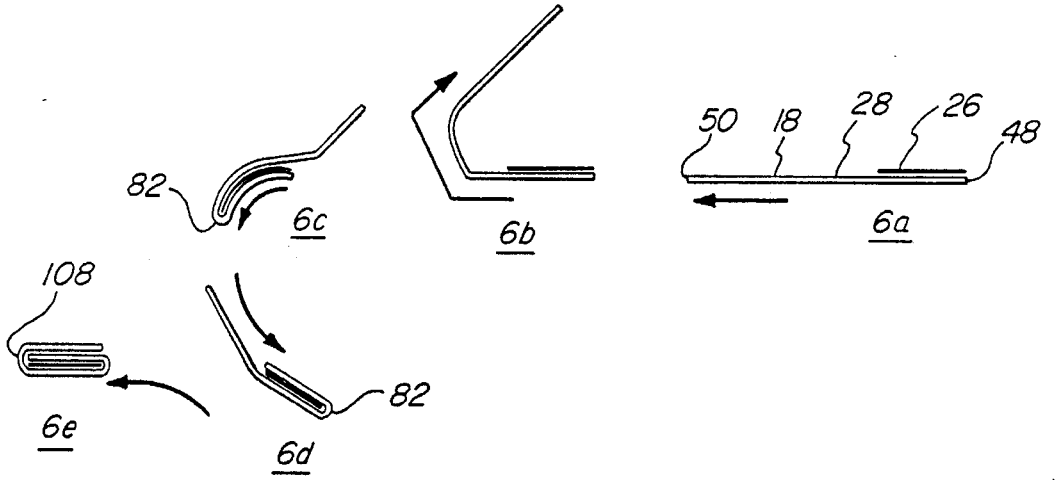
FIG. 6B is a schematic diagrammatic view of the product as it processed through the apparatus of FIG. 6A to create a C-folded product.

In FIGS. 6A and 6B, the folding apparatus 12 is assembled to accomplish C-folding. It should be noted that a bypass device 102 has been mounted at the second station 66 while a buckle plate 104 has been mounted in the third station 68. The buckle plate 104 has an adjustable stop 106 positionable by the user depending upon the size of the product 28. After the product 28 enters the folding apparatus 12, the diverting device 70 diverts the leading edge 50 of the product 28 as the product 28 moves in a first path (see position 6*a*) and changes a direction of movement of the leading edge 50 to a second path (see position 6*b*) into the buckle plate 72. The diverting device 70 moves from its operative position (shown in solid line in FIG. 6A) in the first path of the product 28 as the leading edge 50 thereof exits from the conveyor system to its inoperative position (shown in phantom line in FIG. 6A) spaced from the first path of the product 28. With the diverting device 70 in its inoperative position, the leading edge 50 will engage the adjustable stop 74 to stop further movement of the leading edge 50 of the product 28 in the second path. The cooperating rollers 60,62 continue to drive the product 28 causing an intermediate portion of the product 28 between the leading and trailing edges 48,50 thereof to engage the nip 76 formed by cooperating upper and lower rollers 78,80 to create a first folded edge 82 therein as the product 28 is drawn through the nip 76 in a third path.

At the second station 66, the bypass device 102 has been set up to accept the product 28 coming from the cooperating rollers 78,80 in the third path. The bypass device 102 located in the third path after the nip 76 deflects the product 28 into the nip 88 formed between the rollers 80,90 (position 6*c*).

At the third station 68, the product 28 enters the buckle plate 104 travelling in a fourth path (position 6*d*). When the folded edge 82 of the product 28 engages the adjustable stop 106, further movement thereof in the fourth path stopped. However, the cooperating rollers 90,96 drive the intermediate portion of the product 28 between the nip 94. The rollers 90,96 drawing the product 28 through the nip 94 in a fifth path to create a folded edge 108 at the intermediate portion of the product 28 between the folded edge 82 and the trailing edge 48 thereof. The product 28 is delivered into the output device 46. Thus, a C-folded product is formed.

Figure 7A:
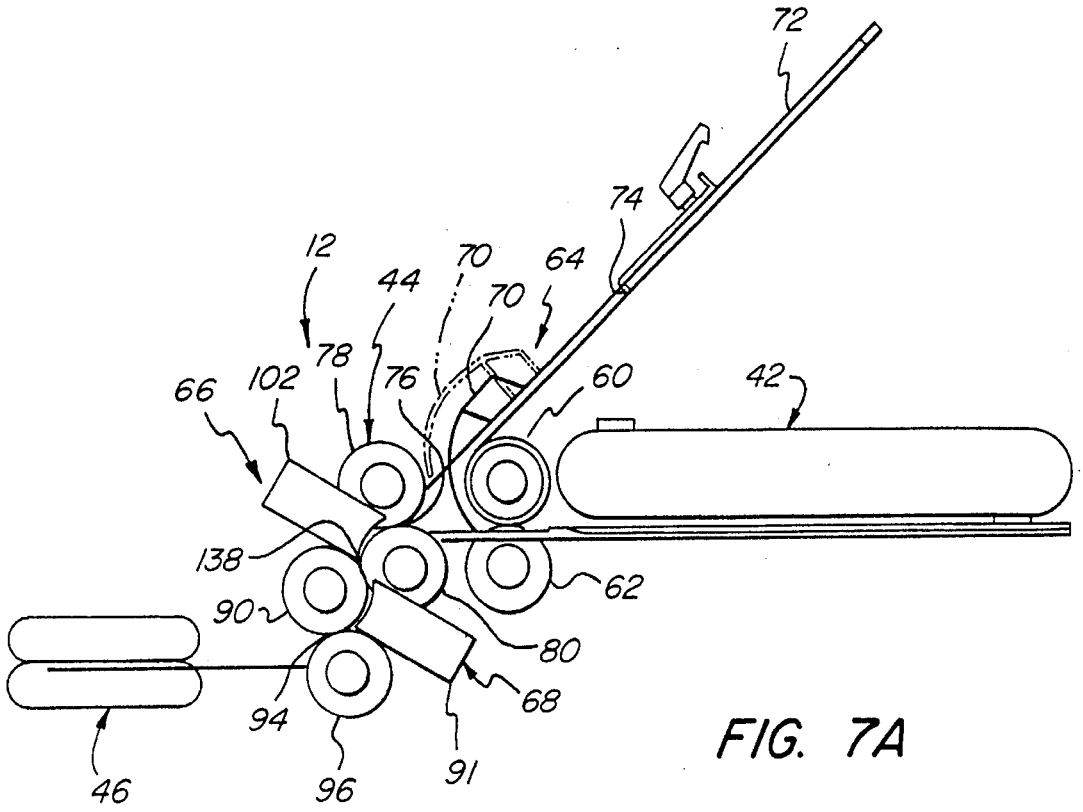
FIG. 7A is a fragmentary side elevational view of the folding apparatus of the present invention set up to create a half-folded product utilizing a thru feed path.
Figure 7B:
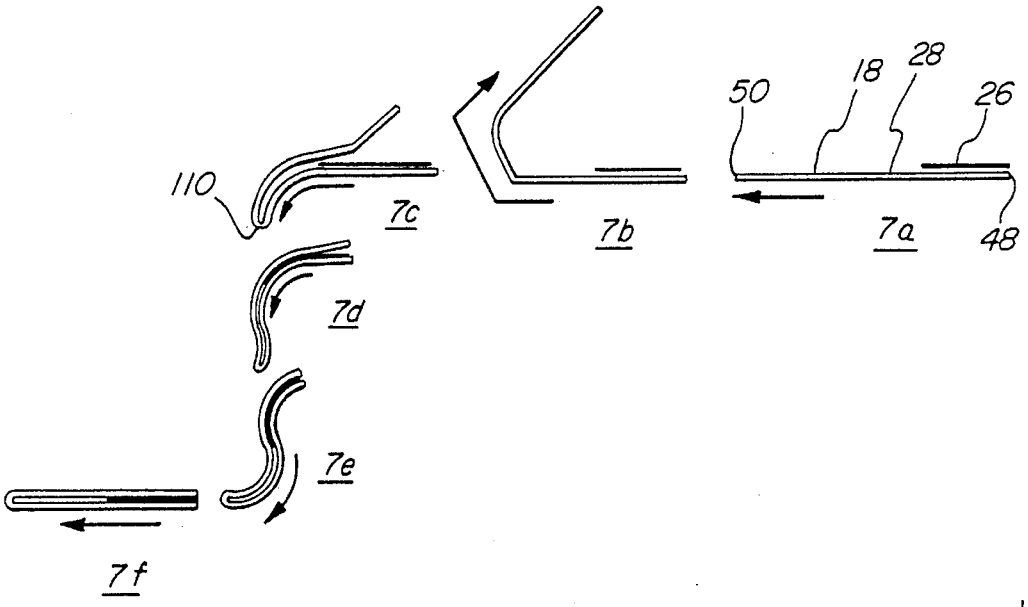
FIG. 7B is a schematic diagrammatic view of the product as it processed through the apparatus of FIG. 7A to create a half-folded product.

In FIGS. 7A and 7B, the folding apparatus 12 is assembled to accomplish half-folding with a thru feed. It should be noted that the bypass device 102 has been mounted at the second station 66 while the bypass device 91 has been mounted in the third station 68. After the product 28 enters the folding apparatus 12, the diverting device 70 diverts the leading edge 50 of the product 28 as the product 28 moves in a first path (see position 7*a*) and changes a direction of movement of the leading edge 50 to a second path (see position 7*b*) into the buckle plate 72. The diverting device 70 moves from its operative position (shown in solid line in FIG. 7A) in the first path of the product 28 as the leading edge 50 thereof exits from the conveying station 22 to its inoperative position (shown in phantom line in FIG. 7A) spaced from the first path of the product 28. With the diverting device 70 in its inoperative position, the leading edge 50 will engage the adjustable stop 74 to stop further movement of the leading edge 50 of the product 28 in the second path. The cooperating rollers 60,62 continue to drive the product 28 causing the intermediate portion of the product 28 between the leading and trailing edges 48,50 thereof to engage the nip 76 formed by cooperating upper and lower rollers 78,80 to create a folded edge 110 therein as the product 28 is drawn through the nip 76 in a third path.

At the second station 66, the output conveyor 100 has been set up to accept the product 28 coming from the cooperating rollers 78,80 in the third path. The bypass device 102 located in the third path after the nip 76 deflects the product 28 into a fourth path between the nip 88 formed by the rollers 80,90 (position 7*c*).

As the product 28 enters the third station 68, the bypass device 91 located in the fourth path after the nip 88 deflects the product 28 into the nip 94 formed between the roller 90 and a roller 96 (position 7*e*). The rollers 90,96 drawing the product 28 through the nip 94 sending the product 28 into the output device 46. Thus, a half-folded product is formed.

Figure 8A:
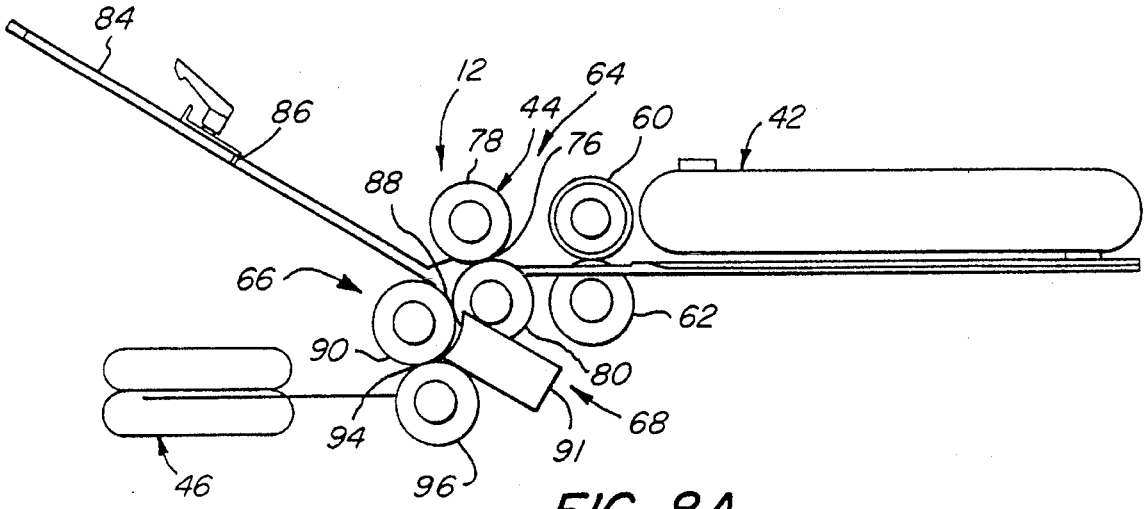
FIG. 8A is a fragmentary side elevational view of the folding apparatus of the present invention set up to create a half-folded product utilizing a downwardly directed fold path.
Figure 8B:
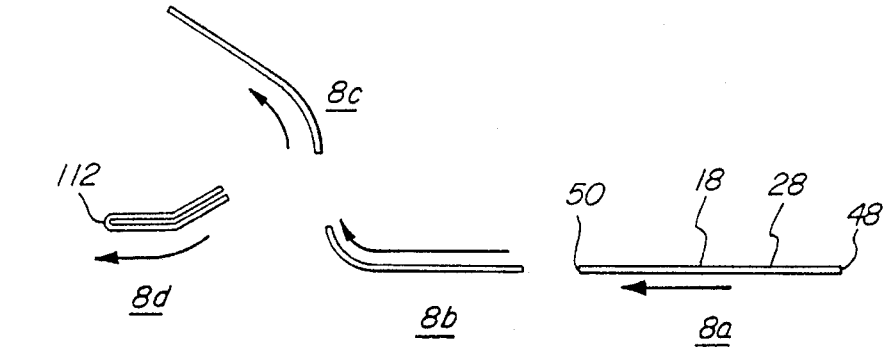
FIG. 8B is a schematic diagrammatic view of the product as it processed through the apparatus of FIG. 8A to create a half-folded product.

In FIGS. 8A and 8B, the folding apparatus 12 is assembled to accomplish half-folding with a downward feed direction. This format of folding cannot be accomplished with an insert forming part of the product 28, i.e., the product 28 is insertless. It should be noted that the buckle plate 84 has been mounted at the second station 66 while the bypass device 91 has been mounted in the third station 68. Also, the diverting device 70 and buckle plate 72 have been removed. Alternatively, the diverting device 70 can merely be placed in its inoperative position. After the product 28 enters the folding apparatus 12, the cooperating rollers 60,62 move the product 28 in a first path (see position 8*a*) to engage the nip 76 formed by cooperating upper and lower rollers 78,80.

As the product 28 is drawn through the nip 76, the buckle plate 84 at the second station 66 accepts the product 28 coming from the cooperating rollers 78,80. The adjustable stop 86 stops the movement of the leading edge 50 of the product 28 as shown in position 8*c*. After the product 28 is stopped, the cooperating rollers 78,80 drive the intermediate portion of the product 28 between the nip 88 formed between the rollers 80,90. The rollers 80,90 draw the product 28 through the nip 88 to create a folded edge 112 at the intermediate portion of the product 28.

As the product 28 enters the third station 68, the bypass device 91 located after the nip 88 deflects the product 28 into the nip 94 formed between the rollers 90,96 (position 8*d*). The rollers 90,96 drawing the product 28 through the nip 94 sending the product 28 into the output device 46. Thus, a half-folded product is formed.

Figure 9A:
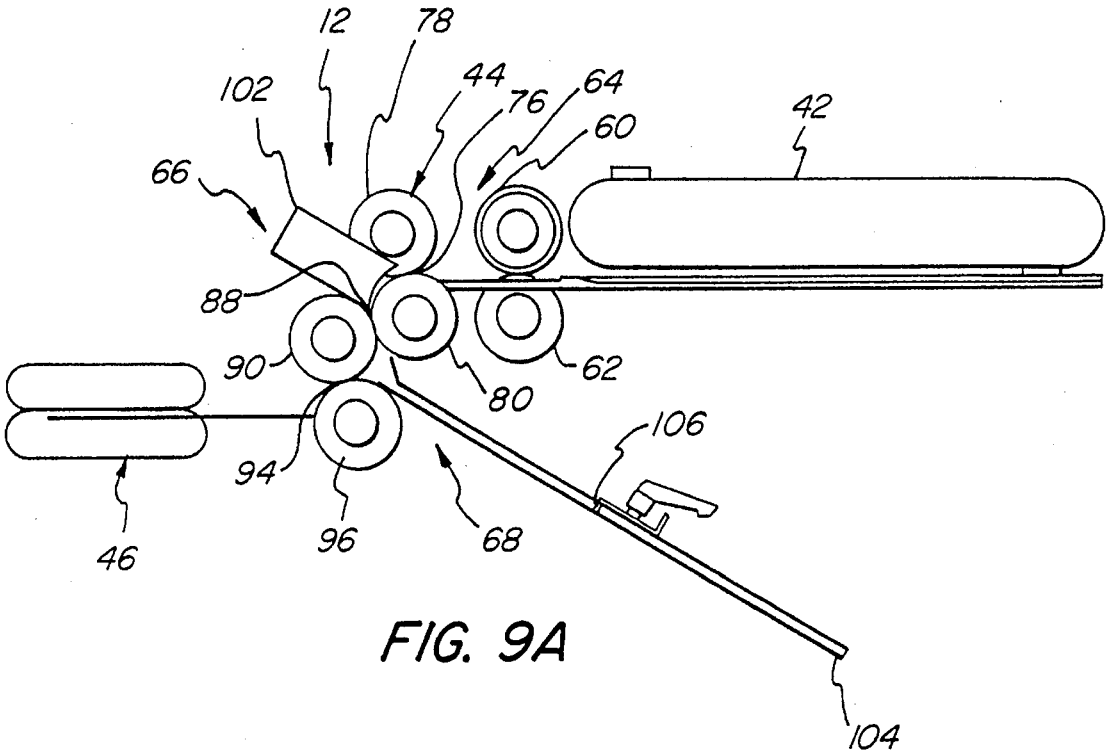
FIG. 9A is a fragmentary side elevational view of the folding apparatus set up to create a half-folded product utilizing a upwardly directed fold path.
Figure 9B:
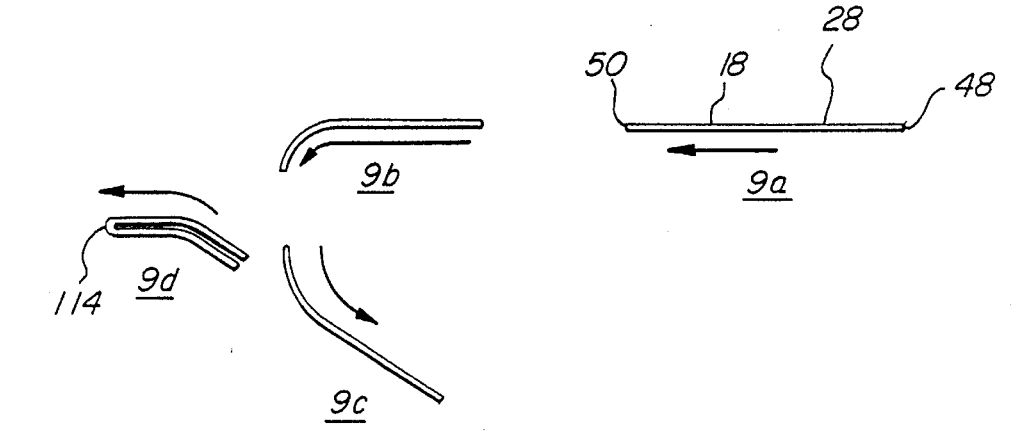
FIG. 9B is a schematic diagrammatic view of the product as it processed through the apparatus of FIG. 9A to create a half-folded product.

In FIGS. 9A and 9B, the folding apparatus 12 is assembled to accomplish half-folding with an upward feed direction. This format of folding cannot be accomplished with an insert forming part of the product 28, i.e., the product 28 is insertless. It should be noted that the bypass device 102 has been mounted at the second station 66 while the buckle plate 104 has been mounted in the third station 68. Also, the diverting device 70 and buckle plate 72 have been removed. Alternatively, the diverting device 70 can merely be placed in its inoperative position. After the product 28 enters the folding apparatus 12, the cooperating rollers 60,62 move the product 28 in a first path (see position 9*a*) to engage the nip 76 formed by cooperating upper and lower rollers 78,80.

As the product 28 is drawn through the nip 76, the bypass device 102 at the second station 66 located after the nip 76 deflects the product 28 into the nip 88 formed between the rollers 80,90 (position 7*b*). At the third station 68, the product 28 enters the buckle plate 104 (position 9*c*). When the product 28 engages the adjustable stop 106, further movement of the leading edge 50 is stopped. However, the cooperating rollers 90,96 drive the intermediate portion of the product 28 between the nip 94. The rollers 90,96 drawing the product 28 through the nip 94 to create a folded edge 114 at the intermediate portion of the product 28. The product 28 is delivered into the output device 46. Thus, a half-folded product is formed.

Figure 10:
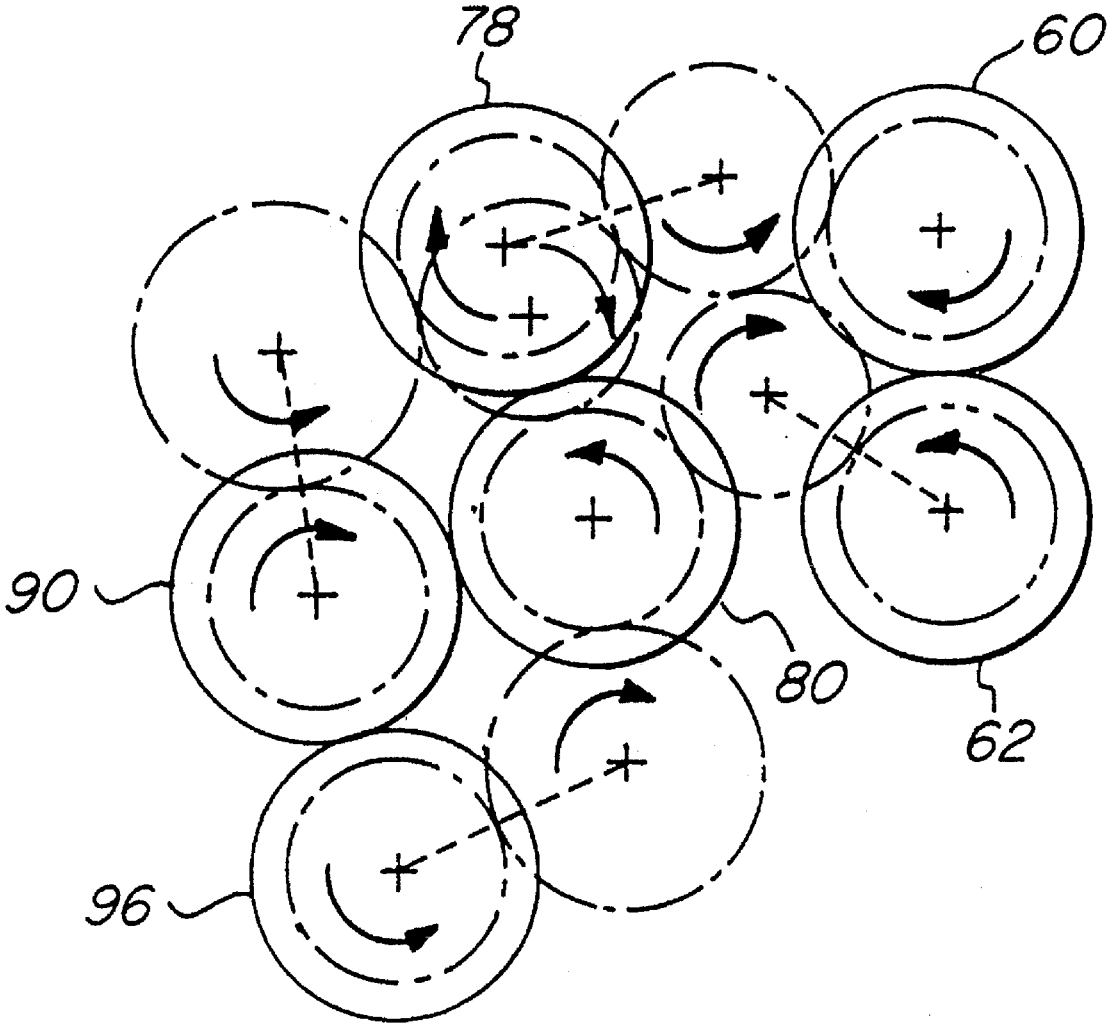
FIG. 10 is a schematic view of the planetary gear system utilized in the present invention.

Turning finally to FIG. 10, it will be appreciated by those skilled in the art that rollers 62, 78, 90 and 96 are spring loaded and pivotally mounted so they can move about axes spaced from their rotational axes and relative to the respective rollers with which they cooperate so products of various thicknesses can be processed in the folding apparatus 12. The artisan of skilled in the art will also appreciate that, in order to accommodate the movement of the rollers 62, 78, 90 and 96, all six of the rollers in the folding apparatus 12 are desirably driven by a planetary gear drive system as shown in FIG. 10. This arrangement allows the folding apparatus 12 of the present invention to fold products which have a total equivalent thickness of eight sheets of twenty pound bond paper in the C-fold and Z-fold formats. In the half-fold format, products having a total equivalent thickness of fifteen sheets of twenty pound bond paper can be accommodated.

As will be appreciated by the artisans skilled in the art, the folding apparatus of the present invention as described herein with its interchangeable bypass and buckle plates can be employed advantageously in a variety of folding applications. It will, therefore, be seen from the above that the invention described above admirably achieves the objects of the invention. However, it will be appreciated that departures can be made by those skilled in the art without departing from the spirit and scope of the invention, which is limited only by the following claims.

Having thus described the invention, what is claimed is:

1. A folding apparatus for providing a product with at least one fold, the product including a document with at least one insert thereon, the document having leading and trailing edges, each insert having a leading edge spaced from the leading edge of the document and having a trailing edge aligned with the trailing edge of the document, the folding apparatus comprising:

(a) a first conveying device for delivering the product in a first path to a folding device, said first conveying device having means for maintaining the trailing edges of each insert in alignment with the trailing edge of the document until the leading edge of each insert is engaged by the folding device; and (b) a folding device for receiving the product from said conveying device, said folding device comprising:

(i) a diverting device for diverting the leading edge of the document as the product moves in the first path and changing a direction of movement of the leading edge of the document to a second path, said diverting device being moveable between an operative position in the first path of the product as the leading edge of the document exits from said first conveying device and an inoperative position spaced from the first path of the product, (ii) means located in the second path for stopping movement of the leading edge of the document along the second path, and (iii) first driven roller means creating a first nip for engaging an intermediate portion of the document between the leading and trailing edges thereof after movement of the leading edge thereof has been stopped in the second path, said first driven roller means drawing the product through said first nip in a third path to create a first folded edge at the intermediate portion of the document without folding the at least one insert, each insert being located between the first folded edge and the trailing edge of the document.

2. The folding apparatus in accordance with claim 1, which further comprises a second conveying device for receiving the product from said folding device and transporting the product therefrom.

3. The folding apparatus in accordance with claim 1, which further comprises:

means located in the third path for stopping movement of the first folded edge of the document along the third path, and second driven roller means creating a second nip for engaging an intermediate portion of the document between the first folded edge and the leading edge thereof after movement of the first folded edge thereof has been stopped in the third path, said second driven roller means drawing the product through said second nip in a fourth path to create a second folded edge at the intermediate portion of the document between the first folded edge and the leading edge thereof without folding the at least one insert.

4. The folding apparatus in accordance with claim 3, further including a bypass device located in the fourth path after said second nip to deflect the product as it moves in the fourth path.

5. The folding apparatus in accordance with claim 3, wherein said means located in the third path for stopping movement of the first folded edge of the document along the third path has a position which is adjustable.

6. The folding apparatus in accordance with claim 3, wherein said first driven roller means and said second driven roller means are each formed of pairs of cooperating rollers, at least one cooperating roller from each pair being pivotally moveable about an axis spaced from its axis of rotation so as to be moveable relative to its respective cooperating roller to accommodate products of varying thicknesses.

7. The folding apparatus in accordance with claim 1, which further comprises:

a bypass device located in the third path after said first nip to deflect the product as it moves in the third path, second driven roller means creating a second nip for engaging the product as it is deflected from said bypass device, said second driven roller means drawing the product through said second nip in a fourth path, means located in the fourth path for stopping movement of the first folded edge of the document along the fourth path, and third driven roller means creating a third nip for engaging an intermediate portion of the document between the first folded edge and the leading edge thereof after movement of the first folded edge thereof has been stopped in the fourth path, said third driven roller means drawing the product through said third nip in a fifth path to create a second folded edge at the intermediate portion of the document between the first folded and leading edges thereof.

8. The folding apparatus in accordance with claim 7, wherein said means located in the fourth path for stopping movement of the first folded edge of the document along the fourth path has a position which is adjustable.

9. The folding apparatus in accordance with claim 7, wherein said first driven roller means, second driven roller means and third driven roller means are each formed of pairs of cooperating rollers, at least one cooperating roller in each pair being pivotally moveable about an axis spaced from its axis of rotation so as to be moveable relative to its respective cooperating roller to accommodate products of varying thicknesses.

10. The folding apparatus in accordance with claim 1, further including:

a first bypass device located in the third path after said first nip to deflect the product as it moves in the third path, second driven roller means creating a second nip for engaging the product as it is deflected from said first bypass device, said second driven roller means drawing the product through said second nip in a fourth path, and a second bypass device located in the fourth path after said first nip to deflect the product as it moves in the fourth path.

11. The folding apparatus in accordance with claim 10, wherein said first driven roller means and said second driven roller means are each formed of pairs of cooperating rollers, at least one cooperating roller in each pair being pivotally moveable about an axis spaced from its axis of rotation so as to be moveable relative to its respective cooperating roller to accommodate products of varying thicknesses.

12. The folding apparatus in accordance with claim 1, wherein said first driven roller means is at least one pair of cooperating rollers, at least one cooperating roller in each pair being pivotally moveable about an axis spaced from its axis of rotation so as to be moveable relative to its respective cooperating roller to accommodate products of varying thicknesses.

13. The folding apparatus in accordance with claim 1, wherein said means located in the second path for stopping movement of the first folded edge of the document along the third path has a position which is adjustable.

14. A kit for forming a folding apparatus for providing a product with at least one fold, the product including a document with at least one insert thereon, the document having leading and trailing edges, each insert having a leading edge spaced from the leading edge of the document and having a trailing edge aligned with the trailing edge of the document, the kit comprising:

(a) a first conveying device for delivering the product in a first path to a folding device, said first conveying device having means for maintaining the trailing edges of each insert in alignment with the trailing edge of the document until the leading edge of each insert is engaged by the folding device; and (b) a folding device for receiving the product from said conveying device, said folding device having a first station, said first station having:

(i) a diverting device being moveable between an operative position in the first path of the product as the leading edge of the document exits from said first conveying device and an inoperative position spaced from the first path of the product, said diverting device being moved to its operative position when a fold is to be made at said first station and being adapted to divert a leading edge of the document as the product moves in the first path and changing a direction of movement of the leading edge to a second path, (ii) means located in the second path for stopping movement of the leading edge of the document along the second path when a fold is to be made, and (iii) first driven roller means creating a first nip for engaging the product, said first nip engaging an intermediate portion of the document between the leading and trailing edges thereof after movement of the leading edge thereof has been stopped in the second path, said first driven roller means drawing the product through said first nip in a third path to create a first folded edge at the intermediate portion of the document without folding the at least one insert.

15. The kit for forming a folding apparatus in accordance with claim 14, which further comprises:

a second station having:

(i) means locatable in the third path for stopping movement of the product along the third path when a fold is to be made at said second station, (ii) a first bypass device locatable in the third path after said first nip when a fold is not to be made at said second station, said first bypass device to deflect the product as it moves in the third path, and (iii) second driven roller means creating a second nip for engaging the product, when a fold is being made at the second station, said second driven roller means engaging an intermediate portion of the document between the leading and trailing edges thereof after movement of the product has been stopped in the third path, said second driven roller means drawing the product through said second nip in a fourth path to create a fold at an intermediate portion of the document between the leading and trailing edges thereof without folding the at least one insert, when a fold is not being made at the second station, said second nip engaging the product as it is deflected from said first bypass device and drawing the product through said second nip in the fourth path.

16. The kit for forming folding apparatus in accordance with claim 15, which further comprises:

a third station having:

(i) means locatable in the fourth path for stopping movement of the product along the fourth path when a fold is to be made at said third station, (ii) a second bypass device locatable in the fourth path after said second nip when a fold is not to be made at said third station, said second bypass device to deflect the product as it moves in the fourth path, and (iii) third driven roller means creating a third nip for engaging the product, when a fold is being made at the third station, said third driven roller means engaging an intermediate portion of the document between the leading and trailing edges thereof when a fold is being made at said third station, after movement of the product has been stopped in the fourth path, said third driven roller means drawing the product through said third nip in a fifth path to create a fold at the intermediate portion of the document between the leading and trailing edges thereof without folding the at least one insert, when a fold is not being made at the third station, said third nip engaging the product as it is deflected from said second bypass device and drawing the product through said third nip in the fifth path.

17. The kit for forming a folding apparatus in accordance with claim 16, wherein said first driven roller means, second driven roller means and third driven roller means are each formed of pairs of cooperating rollers, at least one cooperating roller from each pair being pivotally moveable about an axis spaced from its axis of rotation so as to be moveable relative to its respective cooperating roller to accommodate products of varying thicknesses.

18. The kit for forming a folding apparatus in accordance with claim 16, wherein at least one of said means located in the first, second and third paths for stopping movement of the product along the first, second and third paths, respectively, has a position which is adjustable.

19. The kit for forming a folding apparatus in accordance with claim 15, which further comprises a second conveying device for receiving the product from said folding device and transporting the product therefrom.

* * * * *